US008059070B2

(12) United States Patent
Odawara et al.

(10) Patent No.: US 8,059,070 B2
(45) Date of Patent: Nov. 15, 2011

(54) DISPLAY DEVICE, AND METHODS FOR MANUFACTURING AND CONTROLLING THE DISPLAY DEVICE

(75) Inventors: Rie Odawara, Kyoto (JP); Toshiyuki Kato, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/815,887

(22) Filed: Jun. 15, 2010

(65) Prior Publication Data

US 2010/0253715 A1 Oct. 7, 2010

Related U.S. Application Data

(63) Continuation of application No. PCT/JP2009/002348, filed on May 28, 2009.

(30) Foreign Application Priority Data

May 28, 2008 (JP) ..... 2008-139863

(51) Int. Cl.
*G09G 3/30* (2006.01)

(52) U.S. Cl. ..... 345/77; 345/76

(58) Field of Classification Search ..... 345/76, 345/77, 82, 83; 315/169.3
See application file for complete search history.

(56) References Cited

U.S. PATENT DOCUMENTS

| | | | |
|---|---|---|---|
| 5,359,342 | A | 10/1994 | Nakai et al. |
| 6,229,508 | B1 | 5/2001 | Kane |
| 2001/0024186 | A1 | 9/2001 | Kane et al. |
| 2005/0007360 | A1 | 1/2005 | Matsumoto |
| 2005/0062691 | A1 | 3/2005 | Tamura et al. |
| 2005/0195178 | A1 | 9/2005 | Jo et al. |
| 2005/0206636 | A1 | 9/2005 | Kanai |
| 2006/0284802 | A1 | 12/2006 | Kohno |
| 2007/0229480 | A1 | 10/2007 | Ookawara |

FOREIGN PATENT DOCUMENTS

| | | |
|---|---|---|
| JP | 3-18822 | 1/1991 |
| JP | 11-219146 | 8/1999 |
| JP | 11-282420 | 10/1999 |
| JP | 2000-122598 | 4/2000 |
| JP | 2002-278513 | 9/2002 |
| JP | 2004-151501 | 5/2004 |
| JP | 2005-31136 | 2/2005 |
| JP | 2005-31493 | 2/2005 |
| JP | 2005-250121 | 9/2005 |
| JP | 2005-283816 | 10/2005 |
| JP | 2005-301238 | 10/2005 |
| JP | 2006-113090 | 4/2006 |
| JP | 2006-349966 | 12/2006 |
| JP | 2007-271940 | 10/2007 |

*Primary Examiner* — Ricardo L Osorio
(74) *Attorney, Agent, or Firm* — Greenblum & Bernstein, P.L.C.

(57) ABSTRACT

A display device corrects uneven luminance due to uneven element characteristics by simple measurement and correction with a low cost. The display device includes pixels that each include a light emitter and a driver. Data lines supply a voltage signal to the driver of each pixel. A data line driver supplies the voltage signal to each data line. A first memory stores, for each pixel, a luminance gain for adjusting a luminance corresponding to a video signal to a standard luminance. A second memory stores conversion curve information representing a representative conversion curve common to the pixels. A corrector converts, for each pixel, the luminance into a corresponding standard luminance value based on a corresponding luminance gain stored in the first memory, while a converter converts, for each pixel, the corresponding standard luminance into a corresponding voltage signal based on the conversion information stored in the second memory.

16 Claims, 11 Drawing Sheets

DISPLAY DEVICE, AND METHODS FOR MANUFACTURING AND CONTROLLING THE DISPLAY DEVICE

CROSS REFERENCE TO RELATED APPLICATION

This is a continuation application of PCT Application No. PCT/JP2009/002348 filed on May 28, 2009, designating the United States of America, the disclosure of which, including the specification, drawings, and claims, is incorporate herein by reference in its entirety.

The disclosure of Japanese Patent Application No. 2008-139863 filed on May 28, 2008 including specification, drawings and claims is further incorporated herein by reference in its entirety.

BACKGROUND OF THE INVENTION

1. Field of the Invention

The present invention relates to display devices and methods for manufacturing and controlling the display devices, and in particular to a display devices using a current-driven light emitting elements and methods for manufacturing and controlling the display devices.

2. Description of the Related Art

Image display devices in which organic EL elements (also known as organic light emitting diodes, or OLEDs) are used, that is, organic EL displays are known as image display devices with which current-driven luminescence elements are used. Organic EL displays are attracting attention as candidates of the next-generation flat panel display (FPD) because they have advantages of good viewing angle properties and small power consumption.

In a usual organic EL display, organic EL elements which serve as pixels are arranged in a matrix. An organic EL display is called a passive-matrix organic EL display, in which organic electroluminescence elements are provided at intersections of row electrodes (scanning lines) and column electrodes (data lines) and voltages corresponding to data signals are applied to between selected row electrodes and the column electrodes to drive the organic EL elements.

On the other hand, an organic EL display is called an active-matrix organic EL display, in which thin film transistors (TFTs) are provided at intersections of row electrodes (scanning lines) and column electrodes (data lines) and connected with gates of driving transistors which receive data signals, when the TFTs are turned on through selected scanning lines, through the data lines and activate the organic EL elements.

Unlike the passive-matrix organic EL display, in which organic EL elements connected to selected row electrodes (scanning lines) emit light only until the selected row electrodes become unselected, organic EL elements in the active-matrix organic EL display keep emitting light until they are scanned (or selected) again; thus causing no reduction in luminance even when a duty ratio increases. Accordingly, the active-matrix organic EL display is operated at a low voltage, thereby consuming less power. However, a problem of unevenness in luminance occurs in the active-matrix organic EL display because luminance values are different among pixels due to a variation in characteristics of driving transistors or organic EL elements even when the same data signals are provided.

In conventional organic EL displays, such unevenness in luminance due to a variation or degradation in characteristics (hereinafter collectively referred to as unevenness in characteristics) of driving transistors or organic EL elements has typically been compensated by using complicated pixel circuitry or by feedback compensation using a representative pixel or the sum of currents flowing in all the pixels.

Using complicated pixel circuitry, however, reduces yields. Feedback compensation using a representative pixel or the sum of currents flowing in all the pixels cannot compensate unevenness in characteristics among pixels.

For these reasons, several methods have been proposed for detecting unevenness in characteristics among pixels using simple circuitry.

For example, in the electric optical device, the method for driving the electric optical device, the method for manufacturing the electric optical device, and the electric device which are disclosed in Patent Reference indicated below, the luminance of each pixel is measured using at least one kind of input current in an electric current program pixel circuit, the measured luminance ratio of each pixel is stored in a memory capacitor, image data is corrected based on the luminance ratio, and the electric current program pixel circuit is driven using the corrected image data. This suppresses unevenness in luminance, thereby achieving uniform display.

[Related Art Document]

[Patent Reference] Japanese Unexamined Patent Application Publication No. 2005-283816.

SUMMARY OF THE INVENTION

However, the aforementioned problem solving means require that luminance or current is initially measured in the luminance compensation using the external memory. In the particular case where current is initially measured, long time is required for the initial measurement in order to measure a desirable accurate current with consideration of the parasitic capacitance and line resistance of the whole circuit. Thus, compensation for uneven luminance which is executed while keeping a correction accuracy entails a problem of an increase in the manufacturing cost. Further, the time to measure the whole panel increases as the panel size or the number of input tones increases, which places a significant burden on the manufacturing cost.

In contrast to the electric current program pixel circuit which determines light emission luminance by applying a data current from outside, the application is given for correcting uneven luminance in each pixel in the data voltage application type pixel circuit which determines light emission luminance by applying a data voltage from outside. However, in the data voltage application type pixel circuit, the luminance correction data of each pixel is not uniquely determined by only measuring the luminance ratio of each pixel with respect to the same voltage using one kind of input tone, based on the non-linear relational characteristics between the input voltages and the luminance values. In order to calculate luminance correction data of each pixel applicable in a necessary input tone range, at least two kinds of input tones are required in the measurement. In this case, even when it takes not so much time to perform one measurement of an input voltage and a luminance using one kind of input tone, it takes long accumulation time to perform plural measurements. This increases the manufacturing cost, and requires complex correction processing in the light emission driving.

FIG. 1 is a block diagram showing an electric structure of a conventional display device which performs luminance compensation using an external memory. A display device 800 in the diagram includes a control circuit 801, a memory 802, a scanning line driving circuit 803, a data line driving circuit 804, and a display unit 805.

The control circuit 801 has a function for controlling the memory 802, the scanning line driving circuit 803, and the data line driving circuit 804. The memory 802 stores a video to luminance conversion look up table (hereinafter referred to as a "video to luminance LUT") used to convert a video signal into a luminance signal corresponding to the video signal, and correction data for each pixel. The pixel circuit in the display unit 805 is a data voltage application type pixel circuit.

FIG. 2 is a functional block diagram of the control circuit 801 and the memory 802 shown in FIG. 1. The control circuit 801 in the diagram includes a correction conversion block 851, and a timing controller 864 for a driving circuit. The correction conversion block 851 includes a pixel position detection unit 861, a video to luminance conversion unit 862, and a luminance to voltage conversion unit 863. The control circuit 801 corrects and converts a video signal inputted from outside into a voltage signal corresponding to each pixel using the correction conversion block 851, and generates an output signal to a data line and scanning line driving circuit using the timing controller 864 for a driving circuit.

More specifically, when the video signal is inputted from outside, the control circuit 801 causes the video to luminance conversion unit 862 to read, from the memory 802, the luminance signal corresponding to the video signal. In addition, the control circuit 801 causes the pixel position detection unit 861 to detect the pixel position of the video signal, based on a synchronizing signal which is inputted simultaneously with the video signal. Here, it is assumed that the detected pixel position is at the intersection of Line a and Column b, and the converted luminance signal is c.

Next, the control circuit 801 causes the luminance to voltage conversion unit 863 to read the voltage signal corresponding to the luminance signal c from the conversion look up table (hereinafter referred to as a "conversion LUT") that is the conversion data for correction corresponding to the intersection of Line a and Column b stored in the memory 802.

Lastly, the control circuit 801 outputs the corrected and converted voltage signal of each pixel to the data line driving circuit 804. The voltage signal is either converted into an analog voltage and inputted to the data line driving circuit, or converted into an analog voltage in the data line driving circuit. Subsequently, the analog signal is supplied, as a data voltage, from the data line driving circuit to each pixel.

However, in the aforementioned conventional correction processing and the configuration, the luminance signal to voltage signal conversion table which is used to convert the luminance signal corresponding to the video signal inputted from outside into a voltage signal is stored on a per pixel unit basis. The luminance signal to voltage signal conversion table is stored for use in sequential processes of correcting the luminance characteristics of the display panel in which luminance of each pixel varies to common characteristics and converting the corrected luminance characteristic signal into a voltage signal. In this case, the luminance signal to voltage signal conversion table is unique to each pixel unit, and as described above, includes, for each pixel unit, (luminance signal and voltage signal) data corresponding to at least two kinds of input tones. Thus, the luminance signal to voltage signal conversion table for each pixel must include a huge amount of data. Accordingly, a huge memory capacity is required for a full set of such tables for all the pixels. This results in a problem that the manufacturing cost is increased.

In addition, the video signal corresponding to each pixel is corrected using a huge amount of data, which makes complex the correction process performed when each pixel is driven to emit light.

As described above, in order to achieve organic EL displays which suppress uneven luminance, the conventional techniques entail the problems that either a large number of tones is required for the initial measurement or the manufacturing cost is large, and that the data processing after the measurement is complex.

The present invention has been made in view of this. The present invention has an object to provide a display device which includes data voltage application type pixel circuits which reduce manufacturing cost and require only simple measurement and correction processes, and which is thus capable of correcting uneven luminance due to unevenness in the characteristics of driving active elements and light emitting elements, and provide methods for manufacturing and controlling the display device.

In order to solve the above-described problems, the display device according to an implementation of the present invention includes: pixel units each of which includes a light emitting element and a driving element which controls supply of current to the light emitting element; data lines each of which is for supplying a data voltage corresponding to a voltage to be supplied to a gate of the corresponding driving element; a data line driving circuit which supplies the data voltage to the data lines; a first memory unit configured to store, on a per pixel unit basis, a luminance gain which corresponds to the pixel unit and is used to adjust a luminance corresponding to a video signal of the pixel unit to a predetermined reference luminance; a second memory unit configured to store predetermined information representing a representative conversion curve corresponding to relational characteristics between voltages and luminance values of each of the pixel units, the relational characteristics being common to the pixel units, and the predetermined information being stored for common use to the pixel units; a correction unit configured to convert, on a per pixel unit basis, a video signal inputted from outside into a luminance signal, read the luminance gain corresponding to the luminance signal of the pixel unit from the first memory unit, calculate the luminance signal based on the luminance gain, and correct the luminance signal to the predetermined reference luminance; and a conversion unit configured to convert the corrected luminance signal of the pixel unit into a voltage signal, based on the predetermined information corresponding to the representative conversion curve stored in the second memory unit.

Conventionally, conventional display devices store, in each pixel unit, a luminance signal to voltage signal conversion table which is used to convert the luminance signal corresponding to an input video signal into a voltage signal. This is because the luminance characteristics vary among the respective pixel units which make up a display panel. In addition, the luminance signal to voltage signal conversion table for each pixel unit is generated reflecting a conversion curve along which the luminance characteristics of the respective pixel units which make up the display panel are converted into voltage signals. The use of the luminance signal to voltage signal conversion table makes it possible to execute the processes of correcting the luminance characteristics of the display panel whose pixel units have various luminance characteristics to common characteristics, and converting the corrected luminance characteristics signals into voltage signals. Thus, the luminance signal to voltage signal conversion table for each pixel unit must have a huge amount of data. Accordingly, a huge memory capacity is required for a full set of such tables for all the pixels. This increases the manufacturing cost.

In addition, the video signal is corrected using a huge amount of data for each pixel unit, which makes complex the correction process for each pixel unit when the pixel unit is driven to emit light.

According to this embodiment, the conventional luminance signal to voltage signal conversion table is separated, by the functions, into (i) a table for correcting the luminance characteristics of the respective pixel units which make up a display panel, and (ii) a table representing a conversion curve along which the luminance is converted into voltage signals. More specifically, the following are prepared: a first memory for storing, for each pixel unit, a luminance gain which corresponds to the pixel unit and is used to convert the luminance of a video signal corresponding to the pixel unit into a predetermined reference luminance; and a second memory for storing predetermined information which corresponds to a representative conversion curve representing the relational characteristics between the voltages and luminance values of each of the plural pixel units and is used as a common information item among the plural pixel units. Next, the video signal inputted from outside is converted into a luminance signal on a per pixel unit basis. Subsequently, the luminance signal for each pixel unit is corrected to the predetermined reference luminance. Furthermore, the corrected luminance signal for each pixel unit is converted into a voltage signal, and the converted voltage signal is outputted to the data line driving circuit.

The resulting data stored on a per pixel unit basis is a luminance gain which corresponds to each pixel unit and is used to adjust the luminance of the video signal corresponding to the pixel unit into the predetermined reference luminance. Thus, there is no need to prepare, for each pixel unit, a luminance signal to voltage signal conversion table which is used to convert the luminance signal corresponding to a video signal into a voltage signal as conventionally performed. Therefore, the amount of data which is prepared for each pixel unit can be significantly reduced. Although it is necessary to store, for common use to the plural pixel units, the predetermined information which corresponds to the representative conversion curve representing the relational characteristics between the voltages and luminance values of each of the pixel units, the data amount of the predetermined information is very little.

For this, it is possible to significantly reduce the amount of data required to correct various luminance of the respective pixel units of the display panel to obtain video signals having luminance common throughout the display screen. Thereby, the manufacturing cost can be reduced significantly. As the result, it is possible to reduce the manufacturing cost and the driving processing load, and achieve uniform display throughout the display screen.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings.

DESCRIPTION OF THE PREFERRED EMBODIMENTS

Figure 1:
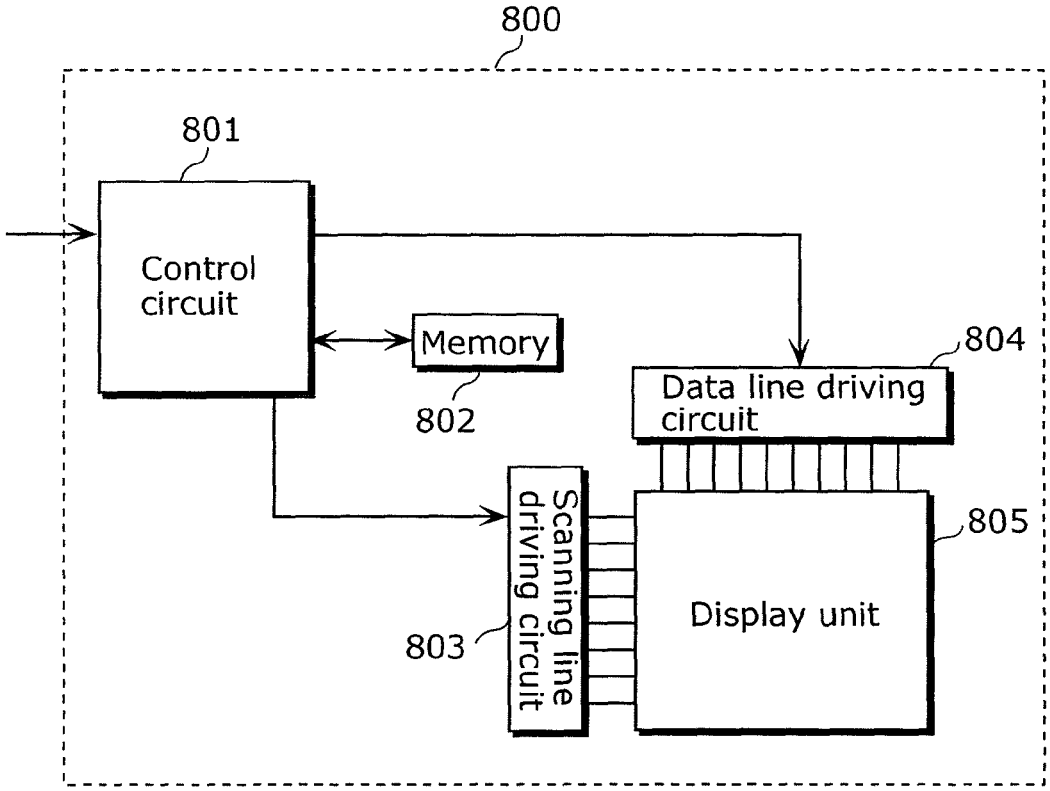
FIG. 1 is a block diagram showing an electric structure of a conventional display device which performs luminance compensation using an external memory.
Figure 2:
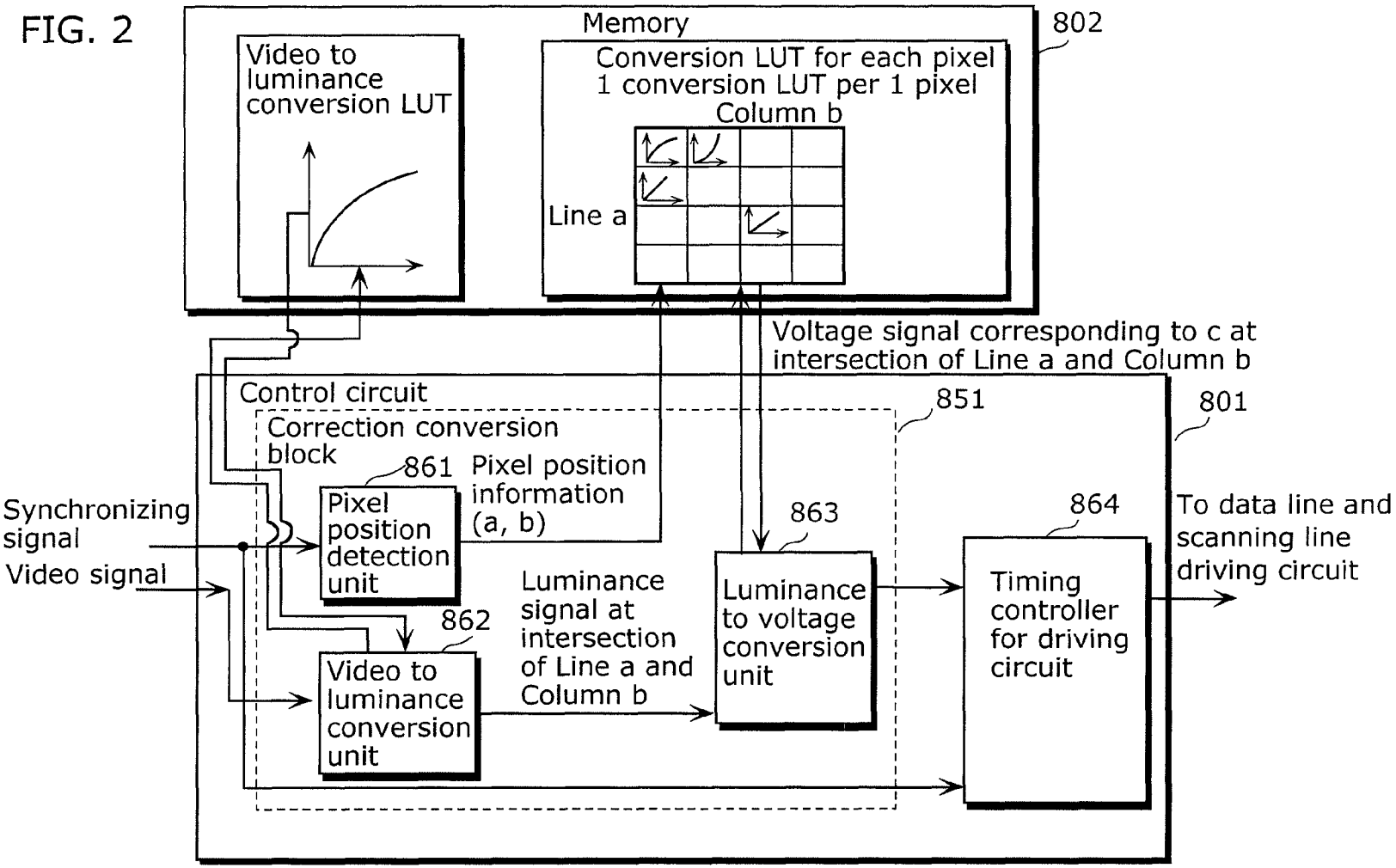
FIG. 2 is a block diagram showing a configuration of a conventional external memory and a control circuit which is included in the display device which performs luminance compensation using the external memory.

A display device according to an implementation of a first aspect of the present invention includes: pixel units each of which includes a light emitting element and a driving element which controls supply of current to the light emitting element; data lines each of which is for supplying a data voltage corresponding to a voltage to be supplied to a gate of the corresponding driving element; a data line driving circuit which supplies the data voltage to the data lines; a first memory unit configured to store, on a per pixel unit basis, a luminance gain which corresponds to the pixel unit and is used to adjust a luminance corresponding to a video signal of the pixel unit to a predetermined reference luminance; a second memory unit configured to store predetermined information representing a representative conversion curve corresponding to relational characteristics between voltages and luminance values of each of the pixel units, the relational characteristics being common to the pixel units, and the predetermined information being stored for common use to the pixel units; a correction unit configured to convert, on a per pixel unit basis, a video signal inputted from outside into a luminance signal, read the luminance gain corresponding to the luminance signal of the pixel unit from the first memory unit, calculate the luminance signal based on the luminance gain, and correct the luminance signal to the predetermined reference luminance; and a conversion unit configured to convert the corrected luminance signal of the pixel unit into a voltage signal, based on the predetermined information corresponding to the representative conversion curve stored in the second memory unit.

According to this aspect, the following units are prepared: a first memory unit configured to store, for each pixel unit, a luminance gain which corresponds to the pixel unit and is used to adjust the luminance of a video signal of the pixel unit into a predetermined reference luminance; and a second memory unit configured to store predetermined information which corresponds to a representative conversion curve representing the relational characteristics between the voltages and luminance values and is used as a common information item among the plural pixel units.

Next, the video signal inputted from outside is converted into a luminance signal on a per pixel unit basis. Subsequently, the luminance signal for each pixel unit is corrected to the predetermined reference luminance. Furthermore, the corrected luminance signal for each pixel unit is converted into a voltage signal, and the converted voltage signal is outputted to the data line driving circuit.

The resulting data stored on a per pixel unit basis is a luminance gain corresponding to each pixel unit and used to adjust the video signal corresponding to the pixel unit into the predetermined reference luminance. Thus, there is no need to prepare, for each pixel unit, a luminance signal to voltage signal conversion table used to convert the luminance signal corresponding to a video signal into a voltage signal as conventionally performed. Therefore, the amount of data prepared for each pixel unit can be significantly reduced. Although it is necessary to store, for common use to the plural pixel units, the predetermined information which corresponds to the representative conversion curve representing the relational characteristics between the voltages and luminance values, the data amount of the predetermined information is very little.

For this, it is possible to significantly reduce the amount of data required to correct various luminance of the respective pixel units of the display panel to obtain video signals having luminance common throughout the display screen.

In addition, processes of converting the video signal into a luminance signal, correcting the luminance signal of each pixel unit into the predetermined reference luminance, and converting the corrected luminance signal into a voltage signal are performed. Among these processes, the second process is performed while reading the luminance gain corresponding to each pixel. Thus, it is possible to simplify the correction processes as a whole to reduce the processing time.

As described above, according to this aspect, the video signal is firstly converted into a luminance signal, and the luminance signal is corrected, and subsequently the process of converting the corrected luminance signal into the voltage signal is performed.

As the result, it is possible to reduce the manufacturing cost and the driving processing load, and achieve uniform display throughout the display screen.

In the display device as an implementation of a second aspect of the present invention and according to the first aspect of the present invention, the second memory unit is configured to store the predetermined information representing the representative conversion curve corresponding to the relational characteristics between the voltages and luminance values of each of the pixel units, the relational characteristics being common to the pixel units, and the predetermined information being stored for common use to the pixel units.

This aspect is intended to store, in the second memory unit, predetermined information which represents a representative conversion curve corresponding to the relational characteristics between the voltages and luminance values and used as a common information item among the plural pixel units. With this, since the predetermined information representing the representative conversion curve corresponding to the relational characteristics between the voltages and luminance values is used as a common information item among the plural pixel units, it is possible to reduce the memory capacity to the minimum.

In the display device as an implementation of a third aspect of the present invention and according to the first aspect of the present invention, the predetermined reference luminance is either a luminance of an arbitrary pixel unit among the pixel units or a luminance obtained by averaging luminance values of each of two or more pixel units among the pixel units, and the luminance gain is a value corresponding to a ratio between (i) the predetermined reference luminance and (ii) either the luminance of each pixel unit among the pixel units or the luminance obtained by averaging the luminance values of each of the two or more pixel units among the pixel units.

According to this aspect, the predetermined reference luminance may be the luminance of an arbitrary pixel unit among the plural pixel units. In addition, in this case, the luminance gain is a value corresponding to the ratio between the predetermined reference luminance and the luminance of each pixel unit among the plural pixel units.

In the display device as an implementation of a fourth aspect of the present invention and according to the first aspect of the present invention, the correction unit is configured to read the luminance gain corresponding to the luminance signal of each pixel unit from the first memory unit, and correct the luminance signal to the predetermined reference luminance by either multiplying or dividing the luminance signal by the luminance gain.

According to this aspect, the calculation performed while reading, from the first memory unit, the luminance gain corresponding to the luminance signal of each pixel unit may be either multiplication or division. With this calculation, since the data as the luminance gain of each pixel is a simple item of real-number data, the correction processing in the light emission driving is simplified. Thus, it becomes possible to achieve uniform display throughout the display screen without placing much driving processing load.

In the display device as an implementation of a fifth aspect of the present invention and according to the first aspect of the present invention, the luminance gain stored for each pixel unit is obtained based on the measured luminance of the pixel unit driven under a same condition as a driving condition used to obtain the predetermined reference luminance.

According to this aspect, the luminance gain stored on a per pixel unit basis is obtained based on the measured luminance of each pixel unit driven under the same condition as used when the predetermined reference luminance is obtained.

In the display device as an implementation of a sixth aspect of the present invention and according to the fifth aspect of the present invention, the same driving condition is to supply same data voltage to the data lines connected to the respective pixel units.

According to this aspect, the same driving condition may be to supply the same data voltage to the data line connected to the pixel unit.

In the display device as an implementation of a seventh aspect of the present invention and according to the fifth aspect of the present invention, the same driving condition is to measure luminance of each pixel unit while driving the pixel unit at a same temperature as a temperature at a time when the predetermined reference luminance is obtained.

According to this aspect, the same driving condition may be to measure the luminance of each pixel unit while driving the pixel unit at the same temperature as used when the predetermined reference luminance is obtained. This makes it possible to obtain the luminance gain in each pixel with a high accuracy and ease.

In the display device as an implementation of an eighth aspect of the present invention and according to the first aspect of the present invention, the representative conversion curve represents relational characteristics between voltages and luminance values of an arbitrary pixel unit among the pixel units.

According to this aspect, the representative conversion curve may represent the relational characteristics between voltages and luminance values of an arbitrary pixel unit among the plural pixel units.

In the display device as an implementation of a ninth aspect of the present invention and according to the first aspect of the present invention, the representative conversion curve represents characteristics obtained by averaging values indicating relational characteristics between voltages and luminance values of each of two or more pixel units among the pixel units.

According to this aspect, the representative conversion curve may be the characteristics obtained by averaging values indicating the relational characteristics between the voltages and luminance values of each of at least two pixel units among the plural pixel units.

The luminance characteristics with respect to the signal voltage in a current pixel match the luminance characteristics with respect to the signal voltages in other pixels when the luminance characteristics of the current pixel is multiplied by an arbitrary gain.

Thus, the luminance characteristics representing the luminance characteristics with respect to the signal voltages of the respective pixels are obtained in advance by averaging either the values indicating the luminance characteristics of all the pixels or the values indicating the luminance characteristics of a part of the pixels. Thus, it is only necessary that simple data which is the aforementioned luminance gain is obtained as the corrected data of each pixel, and it is not necessary to secure a large-capacity memory for storing the obtained luminance gain. Further, the correction process in the light emission driving is simplified. Thus, it becomes possible to achieve uniform display throughout the display screen without requiring much manufacturing cost and driving processing.

In the display device as an implementation of a tenth aspect of the present invention and according to the first aspect of the present invention, information regarding the representative conversion curve representing the relational characteristics between voltages and luminance values is an association table of voltages and luminance values obtained based on the representative conversion curve representing the relational characteristics between the voltages and luminance values of each of the pixel units, the relational characteristics being common to the pixel units, and the association table being stored for common use to the pixel units, and the conversion unit is configured to convert the corrected luminance signal of each pixel unit into a voltage signal with reference to the association table stored in the second memory unit.

According to this aspect, the information about the representative conversion curve representing the relational characteristics between the voltages and luminance values of each of the plural pixel units may be a voltage and luminance association table of the voltages and luminance values obtained based on the representative conversion curve representing the relational characteristics between the voltages and luminance values and thus is for common use to the plural pixel units.

In the display device as an implementation of an eleventh aspect of the present invention and according to the first aspect of the present invention, information regarding the representative conversion curve representing the relational characteristics between the voltages and luminance values is a relational expression representing the relational characteristics between voltages and luminance values of each of the pixel units, the relational characteristics being common to the pixel units, and the relational expression being stored for common use to the pixel units, and the conversion unit is configured to convert the corrected luminance signal of each pixel unit into a voltage signal using the relational expression stored in the second memory unit.

According to this aspect, the information about the representative conversion curve representing the relational characteristics between the voltages and luminance values of each of the plural pixel units may be a relational expression which represents the representative conversion curve representing the relational characteristics between the voltages and luminance values, and thus is for common use to the plural pixel units.

With this, the corrected luminance signal is converted into a corrected voltage signal through simple conversion processing, thereby making it possible to achieve uniform display throughout the display screen without requiring much driving processing load.

In the display device as an implementation of a twelfth aspect of the present invention and according to the first aspect of the present invention, the driving element is a thin film transistor (TFT).

In the display device as an implementation of a thirteenth aspect of the present invention and according to the first aspect of the present invention, the light emitting element is an organic EL element.

A method as an implementation of a fourteenth aspect of the present invention is intended to manufacture a display device which includes: pixel units each of which includes a light emitting element and a driving element which controls supply of current to the light emitting element; data lines each of which is for supplying a data voltage corresponding to a voltage to be supplied to a gate of the corresponding driving element; and a data line driving circuit which supplies the data voltage to the data lines, and the method includes: obtaining predetermined information representing a representative conversion curve corresponding to relational characteristics between voltages and luminance values of each of pixel units, the relational characteristics being common to the pixel units, and the predetermined information being for common use to the pixel units; storing the predetermined information corresponding to the representative conversion curve obtained in the obtaining into a memory unit inside the display device; obtaining a luminance gain which corresponds to each pixel and is used to adjust a luminance of a video signal corresponding to each pixel unit to a predetermined reference luminance; and storing the luminance gain obtained in the obtaining into the memory unit inside the display device.

A method as an implementation of a fifteenth aspect of the present invention is intended to control a display device which includes: pixel units each of which includes a light emitting element and a driving element which controls supply of current to the light emitting element; data lines each of which is for supplying a data voltage corresponding to a voltage to be supplied to a gate of the corresponding driving element; a data line driving circuit which supplies the data voltage to the data lines; a first memory unit configured to store, on a per pixel unit basis, a luminance gain which corresponds to the pixel unit and is used to adjust a luminance corresponding to a video signal of the pixel unit to a predetermined reference luminance; and a second memory unit configured to store predetermined information representing a representative conversion curve corresponding to relational characteristics between voltages and luminance values of each of the pixel units, the relational characteristics being common to the pixel units, and the predetermined information being stored for common use to the pixel units, and the method includes: converting, on a per pixel unit basis, a video signal inputted from outside into a luminance signal; reading a luminance gain corresponding to the luminance signal of the pixel unit from the first memory unit, and calculating the luminance signal based on the luminance gain; correcting the luminance signal of the pixel unit to the predetermined reference luminance; converting the corrected luminance signal of the pixel unit into a voltage signal, based on the predetermined information corresponding to the representative conversion curve stored in the second memory unit; and outputting the converted voltage signal to the data line driving circuit.

As an implementation of a sixteenth aspect of the present invention and according to the fifteenth aspect of the present invention, the method for controlling a display device includes: detecting position information of each pixel unit regarding the video signal inputted from outside; reading the luminance gain corresponding to the detected position information from the first memory unit; converting, on a per pixel unit basis, the video signal inputted from outside into a luminance signal; and calculating luminance signal of the pixel unit based on the luminance gain corresponding to the luminance signal and read from the first memory unit.

Embodiment 1

Embodiments of the present invention are described below with reference to the drawings.

Figure 3:
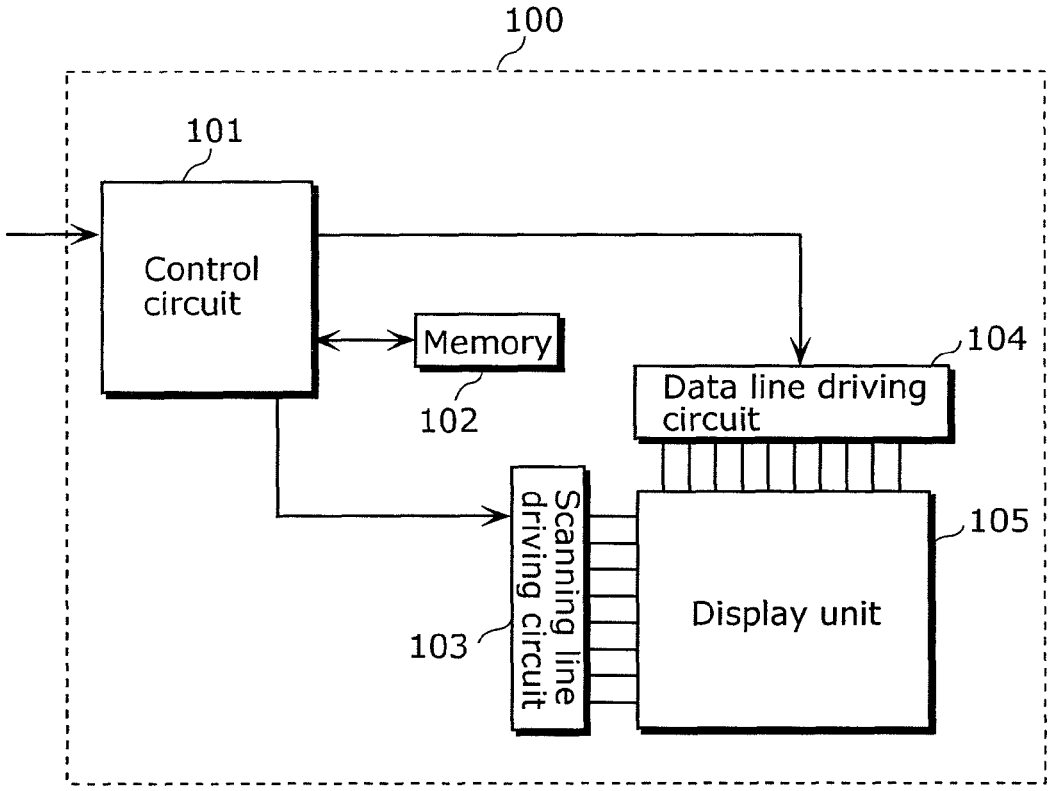
FIG. 3 is a block diagram showing an electric structure of a display device according to an embodiment of the present invention.

FIG. 3 is a block diagram showing an electric structure of a display device 100 according to Embodiment 1 of the present invention. A display device 100 in the diagram includes a control circuit 101, a memory 102, a scanning line driving circuit 103, a data line driving circuit 104, and a display unit 105.

The control circuit 101 has a function for controlling the memory 102, the scanning line driving circuit 103, and the data line driving circuit 104. The memory 102 stores a video to luminance conversion look up table (hereinafter referred to as a "video to luminance LUT") used to convert a video signal into a luminance signal corresponding to the video signal, and a representative look up table (hereinafter referred to as a "representative LUT") derived based on the representative conversion curve. The control circuit 101 reads characteristic parameters written in the memory 102, corrects the video signal data inputted from outside, based on the characteristic parameters, and outputs the data to the data line driving circuit 104.

The scanning line driving circuit 103 is connected to a scanning line 200, and includes a function for controlling between connection and disconnection of a switching transistor 203 of a pixel unit 208.

The data line driving circuit 104 is connected to the data line 201, and has a function for outputting the data voltage and determining signal current to be flown to the driving transistor 204.

The display unit 105 includes plural pixel units 208, and displays an image based on video signals that are the luminance signals inputted from outside to the display device.

Figure 4:
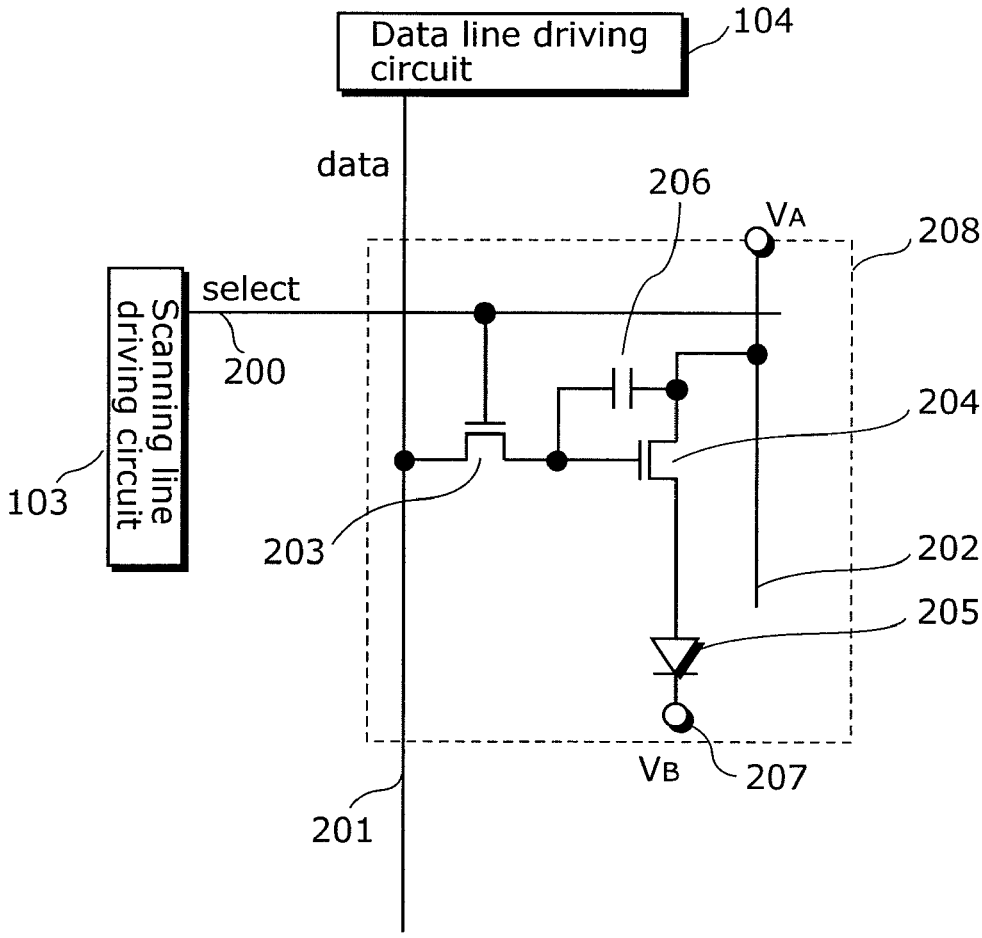
FIG. 4 is a diagram showing a circuit configuration of a pixel unit included in a display unit and connections with the surrounding circuits.

FIG. 4 is a diagram showing a circuit configuration of a pixel unit included in a display unit 105 and connections with the surrounding circuits. The pixel unit 208 in the diagram includes a scanning line 200, a data line 201, an electric power line 202, a switching transistor 203, a driving transistor 204, an organic EL element 205, a holding capacitor 206, and a common electrode 207. In addition, each surrounding circuits includes a scanning line driving circuit 103 and a data line driving circuit 104.

The switching transistor 203 has a gate connected to the scanning line 200, and has a function for controlling the timing for supplying the data voltage of the data line 201 to the gate of the driving transistor 204.

The driving transistor 204 functions as a driving element, and has a gate connected to the data line 201 through the switching transistor 203, a source connected to the anode of the organic EL element 205, and a drain connected to the power line 202. With this, the driving transistor 204 converts the data voltage supplied to the gate into a signal current corresponding to the data voltage, and supplies the converted signal current to the organic EL element 205.

The organic EL element 205 has a function as a light emitting element, and has a cathode connected to the common electrode 207.

The holding capacitor 206 is connected between the power line 202 and the gate terminal of the driving transistor 204. The holding capacitor 206 has a function for holding a gate voltage at the time point which is immediately before the switching transistor 203 falls into an off state even after the time point, and causing the driving transistor 204 to keep supplying the driving current to the organic EL element 205.

It is to be noted that the power line 202 is connected to the power source although it is not shown in FIGS. 3 and 4. In addition, the common electrode 207 is connected to another power source.

The data voltage supplied from the data line driving circuit 104 is applied to the gate terminal of the driving transistor 204 via the switching transistor 203. The driving transistor 204 causes a current corresponding to the data voltage to flow between the source and drain terminals. This current flows into the organic EL element 205, causing the organic EL element 205 to emit light having a light emission luminance according to the current.

Here, detailed descriptions are given of implementations of the control circuit 101 and the memory 102 which are the main parts in the present invention.

Figure 5:
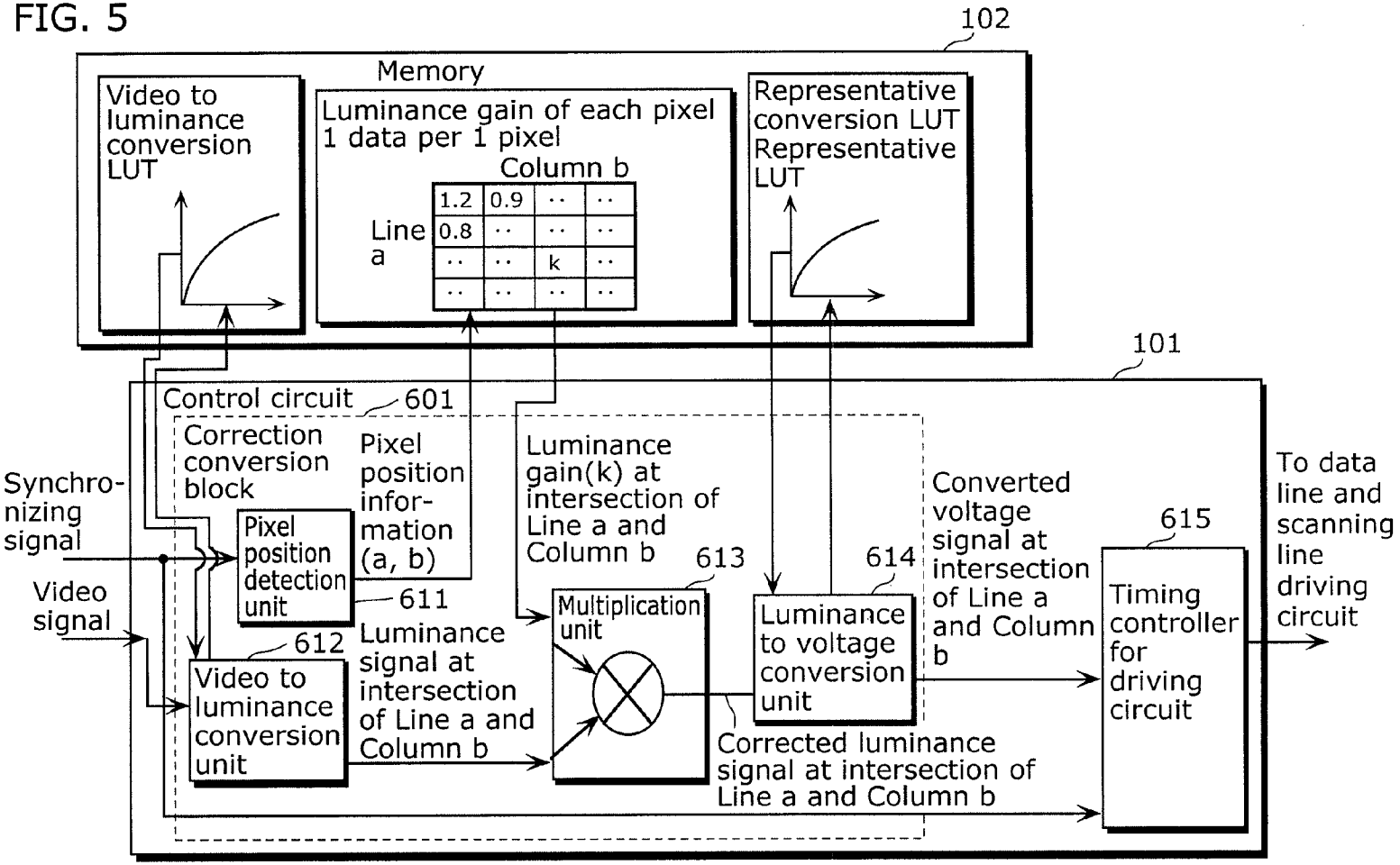
FIG. 5 is a block diagram showing a configuration of a memory and a control circuit which is included in the display device according to the embodiment of the present invention.

FIG. 5 is a functional block diagram showing structures of the control circuit 101 and the memory 102 shown in FIG. 3. The control circuit 101 corrects and converts the video signal inputted from outside into a voltage signal corresponding to each pixel. The memory 102 functions as both the first memory unit storing the luminance gain corresponding to each pixel unit and the second memory unit storing the representative LUT.

The control circuit 101 in the diagram includes a correction conversion block 601 and a timing controller 615 for a driving circuit. First, a description is given of the function of the correction conversion block 601. When the video signal is inputted from outside, the correction conversion block 601 reads the luminance signal corresponding to the video signal with reference to the video to luminance conversion LUT stored in the memory 102. In addition, the correction conversion block 601 reads the luminance gain corresponding to the luminance signal from the memory 102, calculates the luminance signal based on the luminance gain, and corrects the luminance signal to the reference luminance which is for common use to all the pixel units. The correction conversion block 601 includes a pixel position detection unit 611, a video to luminance conversion unit 612, a multiplication unit 613, and a luminance to voltage conversion unit 614.

The pixel position detection unit 611 detects pixel position information of the video signal from the synchronizing signal inputted simultaneously with the video signal inputted from outside. Here, the detected pixel position is assumed to be the intersection of Line a and Column b.

The video to luminance conversion unit 612 reads the luminance signal corresponding to the video signal with reference to the video to luminance conversion LUT stored in the memory 102.

The multiplication unit 613 corrects the luminance signal by multiplying the luminance signal and the luminance gain corresponding to each pixel which are pre-stored in the memory 102 as the first memory unit. More specifically, the luminance signal value at the intersection of Line a and Column b is multiplied by the luminance gain k at the intersection to generate the corrected luminance signal at the intersection.

It is to be noted that the multiplication unit 613 may correct the luminance signal by calculation other than multiplication, for example, by dividing the luminance signal obtained by converting the video signal inputted from outside by the luminance gain pre-stored in the memory 102.

The luminance to voltage conversion unit 614 reads the voltage signal at the intersection of Line a and Column b corresponding to the corrected luminance signal at the intersection outputted from the multiplication unit 613 with reference to the representative LUT derived based on the representative curve stored in the memory 102 which functions also as the second memory unit.

Lastly, the control circuit 101 outputs the converted voltage signal at the intersection of Line a and Column b to the data line driving circuit 104. The voltage signal is either converted into an analog voltage and inputted to the data line driving circuit, or converted into an analog voltage in the data line driving circuit. Subsequently, the analog signal is supplied, as a data voltage, from the data line driving circuit to each pixel.

According to this aspect, the correction conversion block 601 converts, on a per pixel unit basis, the video signal inputted from outside into a luminance signal of each pixel unit, and corrects the luminance signal to a predetermined reference luminance. Furthermore, the corrected luminance signal of each pixel unit is converted into a voltage signal, and the converted voltage signal is outputted to the data line driving circuit.

The resulting data stored on a per pixel unit basis is a luminance gain corresponding to each pixel unit and used to convert the video signal corresponding to the pixel into the predetermined reference luminance. Thus, there is no need to prepare, for each pixel unit, a luminance signal to voltage signal conversion table used to convert the luminance signal corresponding to a video signal into a voltage signal as conventionally performed. Therefore, the amount of data prepared for each pixel unit can be significantly reduced. Although it is necessary to store, for common use to the plural pixel units, the predetermined information which corresponds to the representative conversion curve representing the relational characteristics between the voltages and luminance values, the data amount of the predetermined information is very little.

For this, it is possible to significantly reduce the amount of data required to correct various luminance of the respective pixel units of the display panel to obtain video signals having luminance common throughout the display screen. This reduces the manufacturing cost significantly. As the result, it is possible to reduce the manufacturing cost and the driving processing load, thereby achieving uniform display throughout the display screen.

In addition, since the predetermined information representing the representative conversion curve corresponding to the relational characteristics between the voltages and luminance values is used as a common information item among the plural pixel units, it is possible to reduce the memory capacity to the minimum.

It is to be noted that the representative conversion curve stored in the memory 102 may be a relational expression representing the representative conversion curve, instead of the look up table. In this case, the correction conversion block 601 may read the relational expression and the coefficients from the memory 102, and calculate the read-out relational expression using the coefficients, and convert the corrected luminance signal at the intersection of Line a and Column b outputted from the multiplication unit 613 into a voltage signal at the intersection of Line a and Column b.

In addition, although the memory 102 functions as both the first memory unit storing the luminance gain corresponding to each pixel unit, and the second memory unit storing the representative LUT, separated memories may be used instead.

It is desirable that a gamma table for adjusting the gamma of an image is prepared to be used by a block upstream of this correction conversion block 601.

Here, descriptions are given of the luminance gain and representative conversion curve which are used by the aforementioned correction conversion block 601.

Figure 6A:
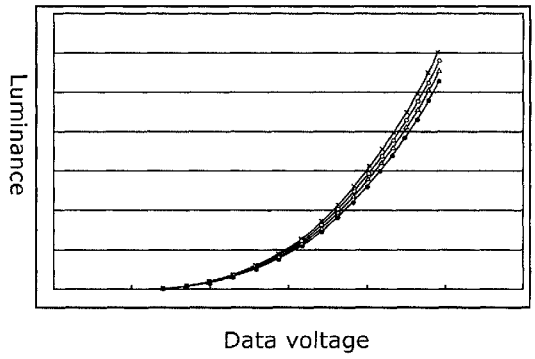
FIG. 6A is a graph with plots representing the luminance values of the respective pixels within a panel with respect to data voltages.

FIG. 6A is a graph including plots representing the luminance of each of pixels within a panel with respect to data voltages. The diagram shows the relational characteristics between data voltages and luminance values of each of the pixels within a panel including a voltage driving pixel circuit in which variation in the light emission efficiencies of organic EL elements is dominant over any other variations in the manufacturing processes. The diagram shows that the luminance values of the respective pixels vary due to unevenness in the characteristics of the light emitting elements even when the same data voltage is applied thereto. In this case, undesired uneven luminance is inevitably produced even though video signals of the same level are applied onto the whole surface of the panel.

Figure 6B:
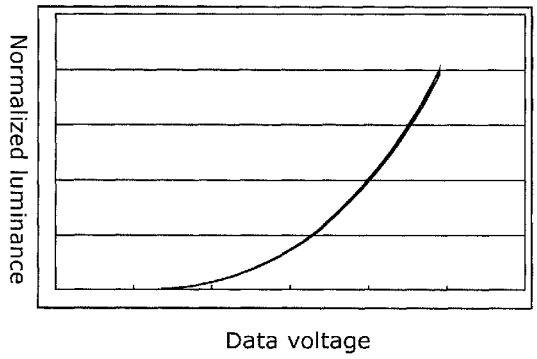
FIG. 6B is a graph obtained by normalizing the relational characteristics between the data voltages and luminance values of each of the pixels shown in FIG. 6A using the relational characteristics between data voltages and luminance values of an arbitrary pixel.

In addition, FIG. 6B is a graph obtained by normalizing the relational characteristics between the data voltages and luminance values of each of the pixels shown in FIG. 6A using the relational characteristics between data voltages and luminance values of an arbitrary pixel. The diagram shows that it is possible to match the characteristic curves of the respective pixels with each other by multiplying the value indicating the relational characteristics between the data voltages and luminance values of each pixel by a corresponding gain in the luminance axis. This is based on the relational characteristics that the light emission luminance of each organic EL element is in proportion to a flowing current and the light emission efficiency.

In addition, the same result is obtained in a panel in which variation in the mobility of the TFT is dominant over any other variations in the manufacturing processes. This is because the light emission luminance of each organic EL element is approximately proportional to a flowing current, and the current flowing between the source and drain of the TFT is proportional to the mobility. For example, when the mobility levels of the TFTs of the respective pixel units vary in a range from $\beta 1$ to $\beta n$, a threshold voltage for each pixel unit is a common Vth, and the data voltage to be applied to the gate of the driving transistor 204 of the n-th pixel unit is a variable V, and the drain current $I_{DS}n$ is as indicated below.

$$I_{DS}n=(1/2)\cdot\beta n\cdot(V-Vth)^2 \quad \text{(Expression 1)}$$

In addition, when the light emission luminance of the organic EL element of the n-th pixel unit is Ln, Ln has a relational characteristics that it is proportional to the light emission efficiency of the drain current $I_{DS}n$, and thus is as indicated below.

$$Ln=kn\cdot I_{DS}n \quad \text{(Expression 2)}$$

Here, kn is a proportionality constant between the light emission luminance Ln and the drain current $I_{DS}n$ in the n-th pixel unit.

From Expressions 1 and 2, the light emission luminance Ln of the organic EL element 205 is as indicated below.

$$Ln=(1/2)\cdot kn\cdot\beta n\cdot(V-Vth)^2 \quad \text{(Expression 3)}$$

Expression 3 shows that the light emission luminance Ln of the organic EL element 205 is represented as a quadratic curve of the data voltage V in the case of using knβn/2 as a coefficient, and that normalization of this knβn/2 yields a representative conversion curve having the quadratic curve common to the pixel units, that is, having $(V-Vth)^2$ as a common factor.

Thus, the representative conversion curve may represent the relational characteristics between voltages and luminance values of an arbitrary pixel unit among the plural pixel units, and may represent the characteristics obtained by averaging the values indicating the relational characteristics between the voltages and luminance values of each of two or more pixel units among the plural pixel units.

According to the aforementioned fact that the relational characteristics between the data voltages and luminance values of each pixel is normalized by the representative conversion curve, the luminance gain of each pixel unit and the representative LUT derived based on the representative curve are stored in the memory 102 included in the display device according to an embodiment of the present invention as indicated below.

With reference to the drawings, descriptions are given below of methods for manufacturing and controlling the display device configured as described above.

Figure 7:
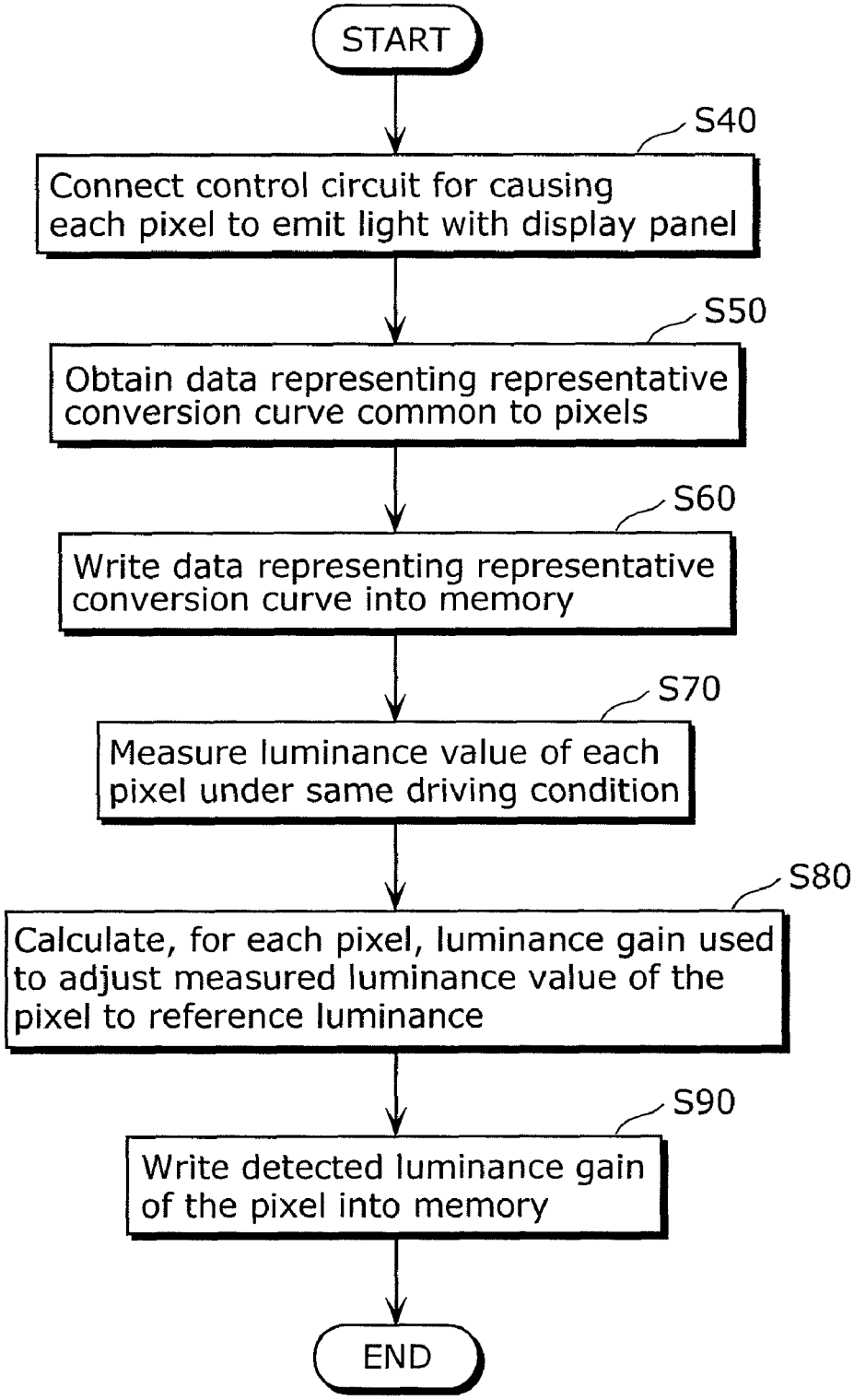
FIG. 7 is an operation flow chart indicating a part of the method for manufacturing a display device according to an embodiment of the present invention.

FIG. 7 is an operation flow chart indicating a part of the method for manufacturing a display device 100 according to an embodiment of the present invention. In this processing, predetermined information representing the representative conversion curve common to the plural pixels and the luminance gain of each pixel are written in the memory 102.

First, a control circuit 101 for causing each pixel unit 208 to emit light is connected to the display unit 105, the scanning line driving circuit 103, and the data line driving circuit 104 which are configured as a part of the display device 100 shown in FIG. 3 (Step S40). This control circuit 101 may be either a control circuit 101 configured as a part of the display device 100 or an external driving circuit for obtaining data to be stored in the memory 102 separate from the control circuit 101.

Next, the control circuit 101 outputs a predetermined voltage to the pixel unit 208 through the scanning line driving circuit 103 and the data line driving circuit 104, and measures the luminance, thereby obtaining the relational characteristics between data voltages and luminance values in each of either all the pixels or a part of the pixels in the panel in which variation in the mobility levels of the driving elements and variation in the light emission efficiencies of the light emitting elements are dominant over any other variations in the manufacturing processes. The control circuit 101 obtains the predetermined information representing the representative conversion curve that shows the relational characteristics between the representative data voltages and normalized luminance values by averaging the values indicating the obtained relational characteristics between the data voltages and luminance values (Step S50). Here, the aforementioned relational characteristics between the data voltages and luminance values in each of either all the pixels or a part of the pixels are obtained from an external PC or the like. The predetermined information is obtained by analyzing the representative conversion curve. Here, to average the values indicating the relational characteristics between the data voltages and luminance values is, for example, to repeatedly measure luminance data of each pixel while changing data voltages step by step, and average these luminance data of each pixel.

It is to be noted that plural pixel units which are selected for such averaging are not necessarily be the plural pixel units extracted from the same panel, and may be plural pixel units which are extracted from different panels.

Otherwise, it is also possible to directly measure an average luminance of each of minute areas including plural pixels using a luminance meter instead of using plural pixels for averaging, and represent the measurements in a representative curve.

Next, the control circuit 101 stores the predetermined information representing the calculated representative conversion curve into the memory 102 (Step S60). The predetermined information representing the calculated representative conversion curve may be, for example, either a representative LUT or a relational expression representing the representative curve and the coefficients.

Next, the control circuit 101 measures the luminance value of each pixel under the same driving condition (Step S70). Here, the same driving condition is to supply the same data voltage to the data line connected to each pixel unit, and specifically, to apply the same data voltage at a certain point to each pixel. With this, it is only necessary to obtain the later-described luminance gain for each pixel in order to correct the luminance signal corresponding to each video signal.

In addition, as the same driving condition, it is desirable that the luminance of each pixel unit is measured by driving the pixel unit at the same temperature as used to obtain the predetermined reference luminance on the representative conversion curve. With this, it is possible to obtain a highly accurate luminance gain and achieve a highly accurate correction for uneven luminance in the light emission driving.

Next, the control circuit 101 calculates a luminance gain of each measured pixel (Step S80). The luminance gain is a ratio between the luminance value of the pixel and the luminance value in the same data voltage value on the representative conversion curve. Here, the luminance gain is a value corresponding to the ratio of the predetermined reference luminance and either the luminance of each pixel unit among the plural pixel units or the luminance obtained by averaging the luminance values of two or more pixel units among the plural pixel units. In addition, the predetermined reference luminance is either the luminance of an arbitrary pixel unit among the plural pixel units or the luminance obtained by averaging the luminance values of two or more pixel units among the plural pixel units.

Lastly, the control circuit 101 stores the calculated luminance gain of each pixel into the memory 102 (Step S90).

Figure 8:
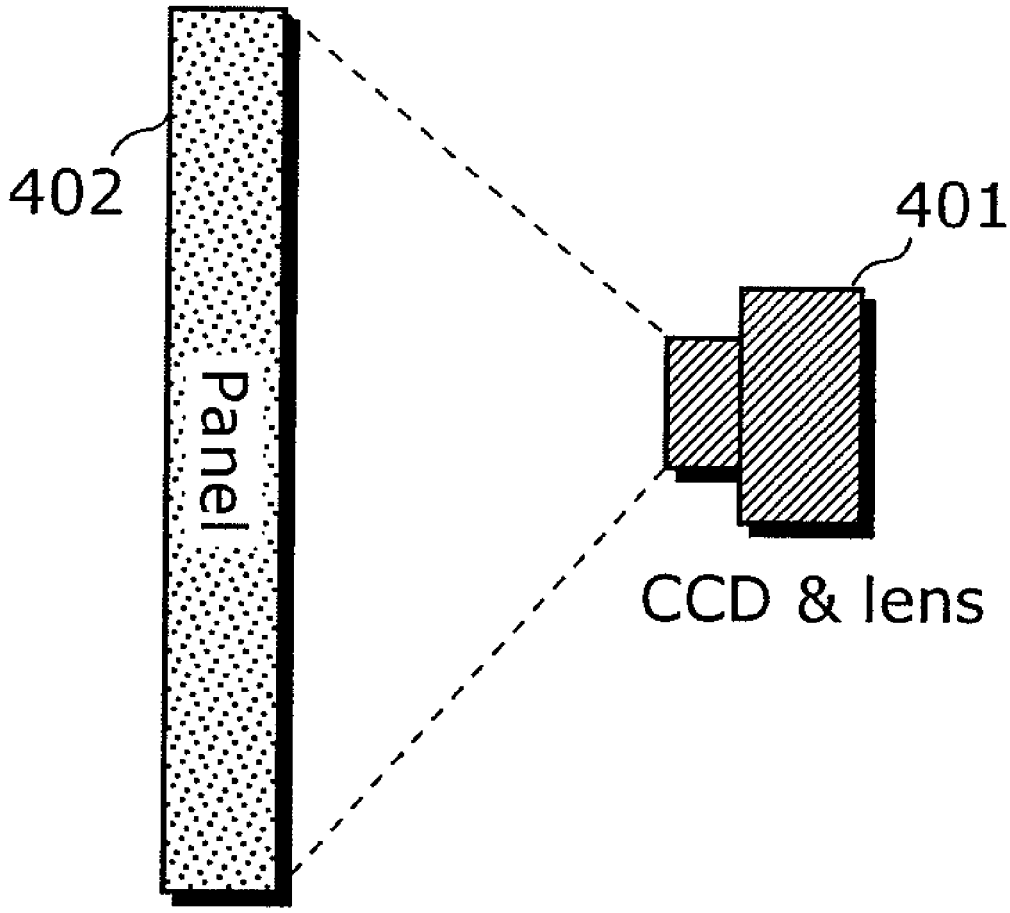
FIG. 8 is a diagram showing a structure for measuring luminance values of plural pixels at one time.

Other than the above-described method for calculating the luminance gain, it is possible to calculate the luminance gain by measuring the luminance of plural pixels in a panel at one time using a CCD and a lens as shown in FIG. 8.

FIG. 8 is a diagram showing a structure for measuring luminance of plural pixels at one time. In this method, the respective pixels in a display panel 402 are driven to emit light at the same driving condition. Next, the luminance of each pixel and the luminance gain are calculated by a CCD camera 401.

According to the above-described manufacturing processes, a video signal is corrected using a luminance gain, and converted into a data voltage to be inputted to each pixel during the display operation. Thus, it is possible to achieve uniform display throughout the display screen without requiring much manufacturing cost and driving processing load.

The representative conversion curve and luminance gain are stored in the same memory in this embodiment, but it is to be noted that the representative conversion curve and luminance gain may be stored in different memories.

In addition, the luminance gain stored in the memory 102 shown in FIG. 4 is not necessarily a data item for each pixel. For example, it is also good to perform measurements for each pixel at two or more kinds of tones for measurement, and calculate a single gain or two or more gains based on the measurements. In this case, a panel including pixels having different tone characteristics can be corrected more accurately than in this embodiment.

In addition, for example, the aforementioned luminance gain may be stored for each different temperature. In this case, a panel including pixels having significant temperature characteristics can be corrected more accurately than in this embodiment.

In addition, the representative conversion curve and either the representative LUT or the relational expression representing the representative conversion curve and the coefficients are not necessarily stored in the memory 102, and may be stored in the control circuit 101.

In addition, the video to luminance conversion curve, the video to luminance conversion LUT, and the relational expression representing the video to luminance conversion curve and the coefficients are not necessarily stored in the memory 102, and may be stored in the control circuit 101.

Figure 9A:
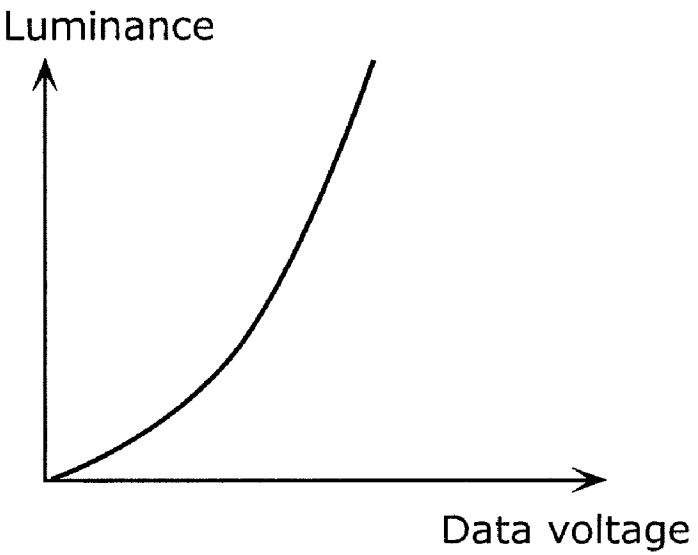
FIG. 9A shows an exemplary curve representing the relational characteristics between data voltages and luminance values as a representative conversion curve common to plural panels.
Figure 9B:
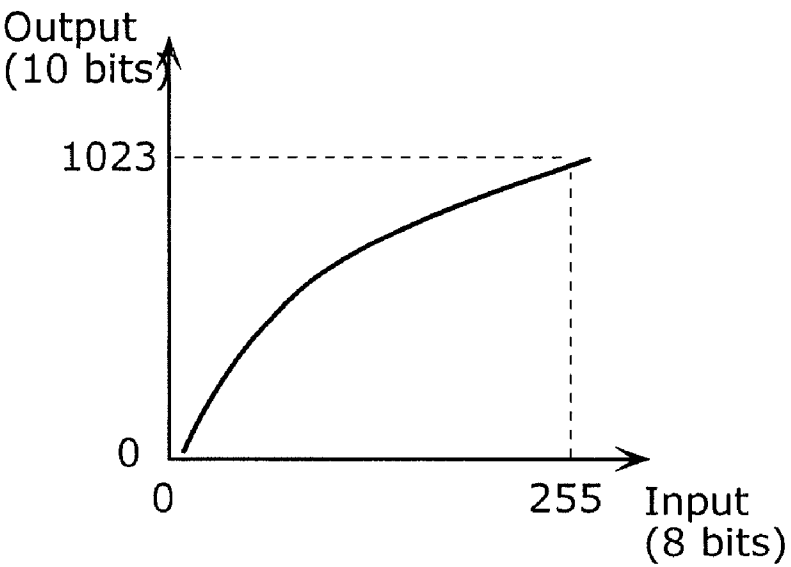
FIG. 9B is an exemplary diagram showing a representative LUT derived from the representative conversion curve.

FIG. 9A shows an exemplary characteristic curve presenting the relational characteristics between data voltages and luminance values as a representative conversion curve common to plural panels. FIG. 9B is an exemplary diagram showing a representative LUT derived from the representative conversion curve. The representative LUT digitally represents inverse functions of the representative conversion curve. In other words, the representative conversion curve as a basis of this representative LUT is multiplied by the luminance gain of each pixel stored in the memory 102, thereby matching the characteristic curve of each pixel with the representative conversion curve. In an exemplary case where the characteristic curve of a bright pixel (Pixel A) matches the representative characteristic curve when multiplied by 0.8, and the characteristic curve of a dark pixel (Pixel B) matches the representative characteristic curve when multiplied by 1.2, the gain of Pixel A is 0.8, and the gain of Pixel B is 1.2.

Figure 10:
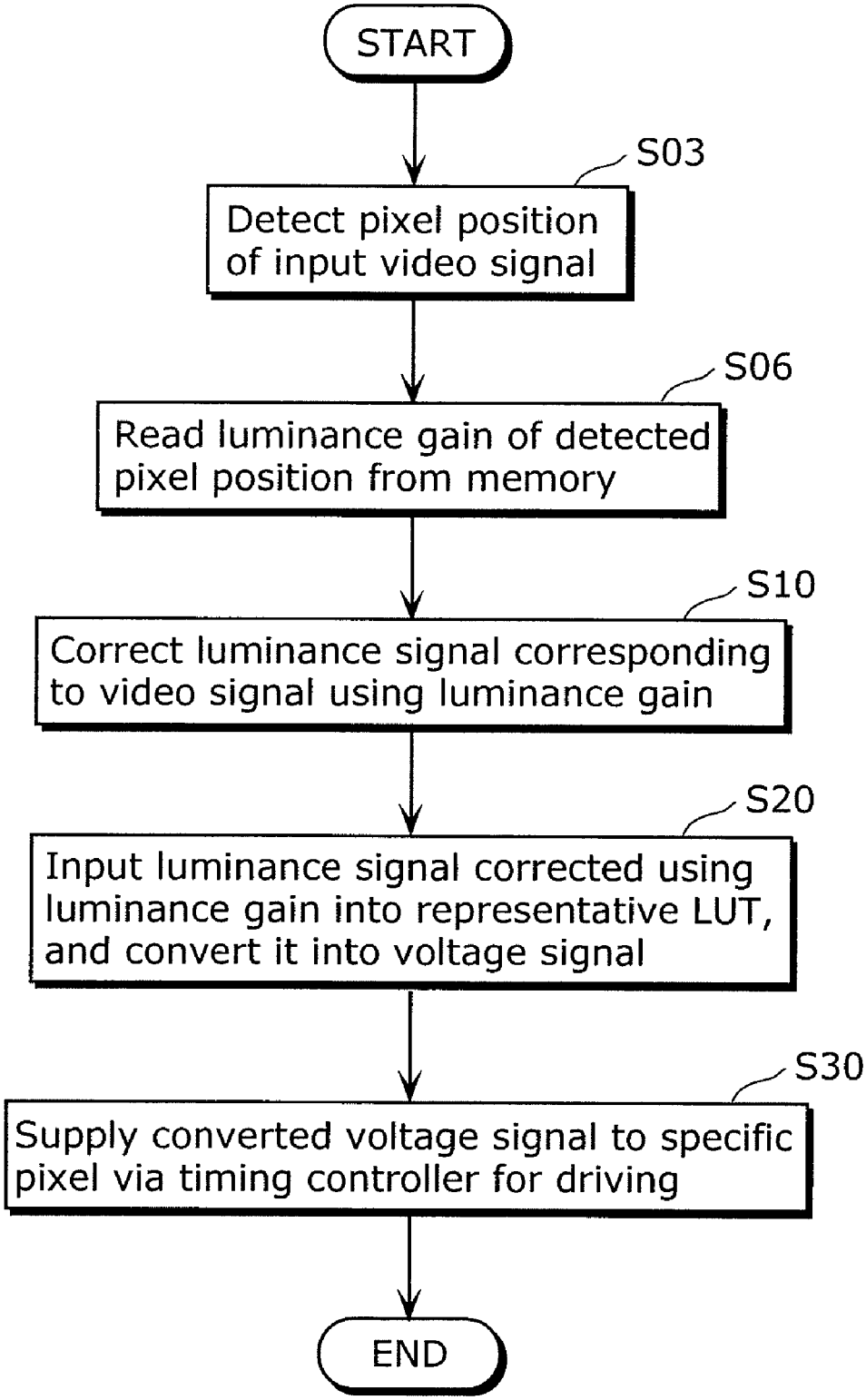
FIG. 10 is a flow chart showing a method for controlling a display device according to an embodiment of the present invention.

Next, a description is given of a method for controlling a display device according to the present invention. FIG. 10 is a flow chart showing a method for controlling the display device 100 shown in FIG. 5. In this processing, the control circuit 101 causes a correction conversion block 601 to obtain the luminance gain corresponding to an input video signal, and to correct the luminance gain to a luminance signal corresponding to the video signal (Steps S03 to S10). Subsequently, the control circuit 101 converts the luminance signal into a voltage signal, and outputs the voltage signal to a specific pixel (Steps S20 to S30).

First, the pixel position detection unit 611 detects position information of the video signal of each pixel using a synchronizing signal inputted simultaneously with the video signal inputted from outside (Step S03). Here, the detected pixel position is assumed to be the intersection of Line a and Column b.

In addition, at this time, the video to luminance conversion unit 612 reads the luminance signal at the intersection of Line a and Column b corresponding to the video signal at the intersection of Line a and Column b inputted from outside with reference to the video to luminance conversion LUT stored in the memory 102.

Next, the control circuit 101 reads the luminance gain corresponding to the video signal of each pixel (at the intersection of Line a and Column b) with reference to the memory 102 (Step S06). Here, it is assumed that the control circuit 101 reads the luminance gain (k) from the memory 102.

Next, the multiplication unit 613 multiplies a luminance signal value of each pixel unit (at the intersection of Line a and Column b) by the read-out luminance gain (k) to correct the luminance signal to the predetermined reference luminance (Step S10).

Next, the luminance to voltage conversion unit 614 reads a digital voltage signal of the pixel unit (at the intersection of Line a and Column b) corresponding to the luminance signal of the pixel unit (at the intersection of Line a and Column b) corrected in Step S10 with reference to the representative LUT for common use to the pixel units stored in the memory 102 (Step S20).

Subsequently, a timing controller 615 for a driving circuit outputs the converted digital voltage signal of the pixel unit (at the intersection of Line a and Column b) to the data line driving circuit 104 (Step S30), and causes the data line driving circuit 104 to supply a corrected analog voltage signal (data signal) to the specific pixel unit (at the intersection of Line a and Column b).

According to the aforementioned control method, each luminance signal is corrected using a luminance gain with a small data amount to be converted into a voltage signal to be inputted to each pixel based on the representative conversion curve common to the plural pixels. With this conversion, the unevenness in the characteristics among the plural pixels is corrected. Therefore, it becomes possible to achieve uniform display throughout the display screen without requiring much manufacturing cost and driving processing load.

Conventionally, each pixel unit in a display device which performs luminance compensation using an external memory stores a luminance signal to voltage signal conversion table used to convert the luminance signal corresponding to an input video signal into a voltage signal. This is because the luminance characteristics vary among the respective pixel units that make up a display panel. In addition, the luminance signal to voltage signal conversion table for each pixel unit is generated reflecting a conversion curve along which the luminance characteristics of the respective pixel units that make up the display panel are converted into voltage signals. The use of the luminance signal to voltage signal conversion table makes it possible to correct the luminance characteristics of the display panel whose pixel units have various luminance values to common characteristics, and convert the corrected luminance characteristic signals into voltage signals. Thus, the luminance signal to voltage signal conversion table for each pixel unit has huge data amount. Accordingly, a huge memory capacity is required for a full set of such tables for all the pixels. This increases the manufacturing cost.

In addition, the video signal is corrected using a huge amount of data for each pixel unit, which makes complex the correcting processing for each pixel unit when the pixel unit is driven to emit light.

In contrast to this, with the display device and the methods for manufacturing and controlling the display device according to the present invention, the conventional luminance signal to voltage signal conversion table is separated, by the functions, into (i) a table for correcting the luminance characteristics of the respective pixel units that make up a display panel, and (ii) a table representing a conversion curve along which the luminance is converted into voltage signals. More specifically, the memory 102 is provided to store, on a per plural pixel unit basis, the luminance gain corresponding to each pixel unit, and store predetermined information which corresponds to the representative conversion curve representing the relational characteristics between the voltages and luminance values and is for common use to the plural pixel units. Next, the video signal inputted from outside is converted into a luminance signal on a per pixel unit basis. Subsequently, the luminance signal for each pixel unit is corrected to the predetermined reference luminance. Furthermore, the corrected luminance signal for each pixel unit is converted into a voltage signal, and the converted voltage signal is outputted to the data line driving circuit 104.

Thus, there is no need to prepare, for each pixel unit, a luminance signal to voltage signal conversion table as exemplary data which is used to convert the luminance signal corresponding to a video signal into a voltage signal as conventionally performed. Therefore, the amount of data prepared for each pixel unit can be significantly reduced. Although it is necessary to store, for common use to the plural pixel units, the predetermined information which corresponds to the representative conversion curve representing the relational characteristics between the voltages and luminance values, the data amount of the predetermined information is very little.

For this, it is possible to significantly reduce the amount of data required to correct various luminance values of the respective pixel units of the display panel to obtain video signals having luminance common throughout the display screen. This reduces the manufacturing cost significantly. As the result, it is possible to reduce the manufacturing cost and the driving processing load, thereby achieving uniform display throughout the display screen.

It is to be noted that the driving transistor 204 and the switching transistor 203 shown in FIG. 4 may be p-channel TFTs.

In addition, the luminance gains for the respective pixels may be calculated by measuring either a current flowing in the organic EL element 205 or the drain current of the driving transistor 204, instead of performing luminance measurements.

Likewise, the representative characteristic curve may be calculated by measuring either a current flowing in the organic EL element 205 or the drain current of the driving transistor 204, instead of performing luminance measurements.

In addition, the pixel circuit may be configured to be a voltage-driven pixel circuit differently from the circuit configuration shown in FIG. 4.

In addition, in stead of the representative LUT, plural representative LUTs may be respectively generated for different units of a line, a column, an area stored depending on the variation tendency in the manufacturing processes.

In addition, since the organic EL elements and TFTs have temperature characteristics, the temperature during the measurement must be controlled. In particular, in the case of measuring a whole panel on a per panel segment basis, it is desirable that the overall measurement is performed at the same temperature.

In addition, the representative LUT may not be a look up table, and may be an approximation representing the curve and the coefficients.

In addition, in the case where a single gain is not sufficient to keep an accuracy in all the tones, gains in two or more kinds of tones may be stored in the memory. Such gains in these tones can be calculated by interpolation.

It is to be noted that the display devices and methods for manufacturing and controlling the display devices according to the present invention are not limited to those in the above-described embodiments. Those skilled in the art will readily appreciate that many modifications are possible in the exemplary embodiments without materially departing from the novel teachings and advantages of this invention, and that display devices according to the present invention can be installed in various devices. Accordingly, all such modifications and implementations are intended to be included within the scope of this invention.

Figure 11:
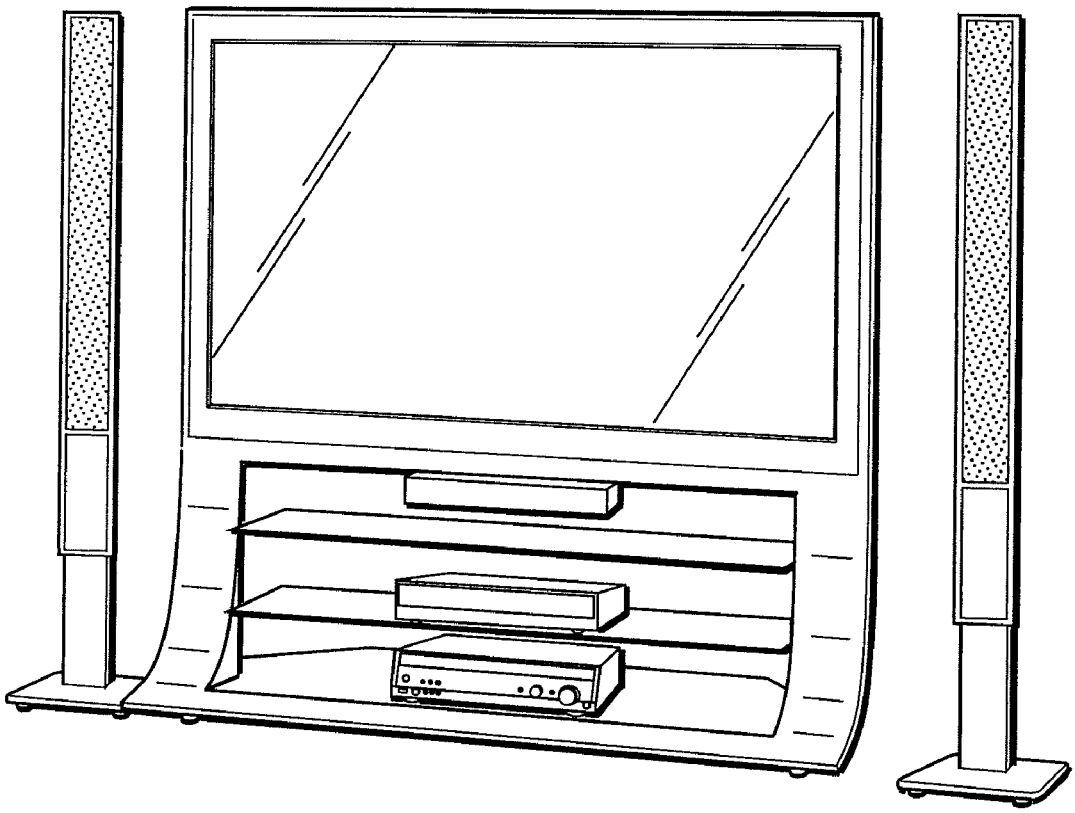
FIG. 11 is an external view of a thin flat TV with a display device according to an embodiment of the present invention.

For example, the display device according to the present invention is installed in a thin flat TV as disclosed in FIG. 11. The use of the display device according to the present invention makes it possible to achieve a low-cost thin flat TV including a display that suppresses luminance unevenness.

INDUSTRIAL APPLICABILITY

The present invention is applicable particularly to flat organic EL panel displays with a display device, and is optimum for display devices with a display which requires uniformity in image quality and methods for manufacturing and controlling the display devices.

What is claimed is:

1. A display device, comprising:

a plurality of pixels, each of the plurality of pixels including a light emitter and a driver, the driver supplying current to the light emitter;

a plurality of data lines, each of the plurality of data lines supplying a voltage signal to one of the plurality of pixels, the voltage signal corresponding to a voltage to be supplied to a gate of the driver included in the corresponding one of the plurality of pixels;

a data line driver that supplies the voltage signal to each of the plurality of data lines;

a first memory configured to store, for each of the plurality of pixels, a luminance gain, the luminance gain being used for adjusting a luminance corresponding to a video signal for each of the plurality of pixels to a standard luminance value;

a second memory configured to store conversion information representing a representative conversion curve, the representative conversion curve representing a relationship between a common voltage and a common luminance, the relationship being common to the plurality of pixels;

a corrector configured to convert, for each of the plurality of pixels, the luminance corresponding to the video signal into a corresponding standard luminance value, based on a corresponding luminance gain stored in the first memory; and a converter configured to convert, for each of the plurality of pixels, the corresponding standard luminance value into a corresponding voltage signal, based on the conversion information stored in the second memory.

2. The display device according to claim 1, wherein the second memory is configured to store the conversion information representing the representative conversion curve for common use to each of the plurality of pixels.

3. The display device according to claim 1, wherein the standard luminance value is one of an arbitrary luminance of an arbitrary pixel among the plurality of pixels and an average luminance obtained by averaging luminance values of at least two pixels among the plurality of pixels, and the luminance gain is a value corresponding to a ratio between (i) the standard luminance value and (ii) one of the luminance of each pixel among the plurality of pixels and the average luminance obtained by averaging the luminance values the at least two pixels among the plurality of pixels.

4. The display device according to claim 1, wherein the corrector is configured to read the corresponding luminance gain corresponding to the luminance of each pixel from the first memory, and correct the luminance to the corresponding standard luminance value by one of multiplying and dividing the luminance by the corresponding luminance gain.

5. The display device according to claim 1, wherein the luminance gain stored for each of the plurality of pixels is obtained based on a measured luminance of each of the plurality of pixels driven under a same driving condition used to obtain the standard luminance value.

6. The display device according to claim 5, wherein the same driving condition is to supply a same voltage signal to the one of the plurality of data lines connected to each of the plurality of pixels.

7. The display device according to claim 5, wherein the same driving condition is to measure a luminance of each of the plurality of pixels while driving each of the plurality of pixels at a same temperature as a temperature at a time when the standard luminance value is obtained.

8. The display device according to claim 1, wherein the representative conversion curve represents relational characteristics between voltages and luminance values of an arbitrary pixel among the plurality of pixels.

9. The display device according to claim 1, wherein the representative conversion curve represents characteristics obtained by averaging values indicating relational characteristics between voltages and luminance values of at least two pixels among the plurality of pixels.

10. The display device according to claim 1, wherein the conversion information representing the representative conversion curve is an association table of voltages and luminance values, and the converter is configured to convert the corresponding standard luminance value of each of the plurality of pixels into the corresponding voltage signal with reference to the association table stored in the second memory.

11. The display device according to claim 1, wherein the conversion information representing the representative conversion curve is a relational expression representing voltages and luminance values, and the converter is configured to convert the corresponding standard luminance value of each of the plurality of pixels into the corresponding voltage signal using the relational expression stored in the second memory.

12. The display device according to claim 1, wherein the driver is a thin film transistor.

13. The display device according to claim 1, wherein the light emitter is an organic electroluminescence element.

14. A method for manufacturing a display device which includes:

a plurality of pixels, each of the plurality of pixels including a light emitter and a driver, the driver supplying current to the light emitter;

a plurality of data lines, each of the plurality of data lines supplying a voltage signal to one of the plurality of pixels, the voltage signal corresponding to a voltage to be supplied to a gate of the driver included in the corresponding one of the plurality of pixels;

a data line driver that supplies the voltage signal to each of the plurality of data lines; and the method comprising:

obtaining conversion information representing a representative conversion curve, the representative conversion curve representing a relationship between a common voltage and a common luminance, the relationship being common to the plurality of pixels;

storing the conversion information representing a representative conversion curve in a memory of the display device;

obtaining, for each of the plurality of pixels, a luminance gain, the luminance gain being used for adjusting a luminance corresponding to a video signal for each of the plurality of pixels to a standard luminance value; and storing, for each of the plurality of pixels, the luminance gain obtained in the obtaining into the memory of the display device.

15. A method for controlling a display device which includes:

a plurality of pixels, each of the plurality of pixels including a light emitter and a driver, the driver supplying current to the light emitter;

a plurality of data lines, each of the plurality of data lines supplying a voltage signal to one of the plurality of pixels, the voltage signal corresponding to a voltage to be supplied to a gate of the driver included in the corresponding one of the plurality of pixels;

a data line driver that supplies the voltage signal to each of the plurality of data lines;

a first memory configured to store, for each of the plurality of pixels, a luminance gain, the luminance gain being used for adjusting a luminance corresponding to a video signal inputted from outside for each of the plurality of pixels to a standard luminance value;

a second memory configured to store conversion information representing a representative conversion curve, the representative conversion curve representing a relationship between a common voltage and a common luminance, the relationship being common to the plurality of pixels; and the method comprising:

correcting, for each of the plurality of pixels, the luminance corresponding to the video signal into a corresponding standard luminance value, based on a corresponding luminance gain stored in the first memory;

converting, for each of the plurality of pixels, the corresponding standard luminance value into a corresponding voltage signal, based on the conversion information stored in the second memory; and outputting, for each of the plurality of pixels, the corresponding voltage signal to the data line driver.

16. The method for controlling the display device according to claim 15, the method further comprising:

detecting position information of each of the plurality of pixels regarding the video signal inputted from outside;

reading, for each of the plurality of pixels, the corresponding luminance gain based on the detected position information from the first memory;

converting, for each of the plurality of pixels, the video signal inputted from outside into the luminance; and calculating, for each of the plurality of pixels, the corresponding standard luminance value based on the corresponding luminance gain corresponding to the luminance and read from the first memory.

* * * * *